United States Patent [19]

Coltrin et al.

[11] 4,263,747

[45] Apr. 28, 1981

[54] WINDOW GRILLE LATCH SYSTEM

[76] Inventors: George E. Coltrin, 4310 Bannister Ave., El Monte, Calif. 91732; Clifford G. Adams, 3840 Bresee Ave., Baldwin Park, Calif. 91706

[21] Appl. No.: 961,615

[22] Filed: Nov. 17, 1978

[51] Int. Cl.[3] ..... E06B 3/68

[52] U.S. Cl. ..... 49/56; 49/141; 292/38

[58] Field of Search ..... 49/50, 56, 57, 61–63, 49/67, 141, 394; 292/37, 38

[56] References Cited

U.S. PATENT DOCUMENTS

| | | | |
|---|---|---|---|
| 2,715,538 | 8/1955 | Janonis | 292/50 |
| 4,019,281 | 4/1977 | Weiler | 49/56 |
| 4,055,360 | 10/1977 | Kussi | 49/141 X |
| 4,057,935 | 11/1977 | Rohrberg et al. | 49/141 X |
| 4,070,048 | 1/1978 | Young | 49/57 X |
| 4,127,966 | 12/1978 | Schmidt | 49/141 |

FOREIGN PATENT DOCUMENTS

| | | | |
|---|---|---|---|
| 856772 | 12/1960 | United Kingdom | 49/141 |

*Primary Examiner*—Kenneth Downey
*Attorney, Agent, or Firm*—Boniard I. Brown

[57] ABSTRACT

A latch system for a hinged window grille that enables quick one point release near the adjacent interior floor. The system includes a latch or latches which are connected to a foot stirrup by means of cables, the stirrup being located close to the floor. Each latch includes spring loaded retention means which engage the head of a penetrator member connected to the grille to secure the side of the grille opposite the hinges.

7 Claims, 6 Drawing Figures

FIG. 1.
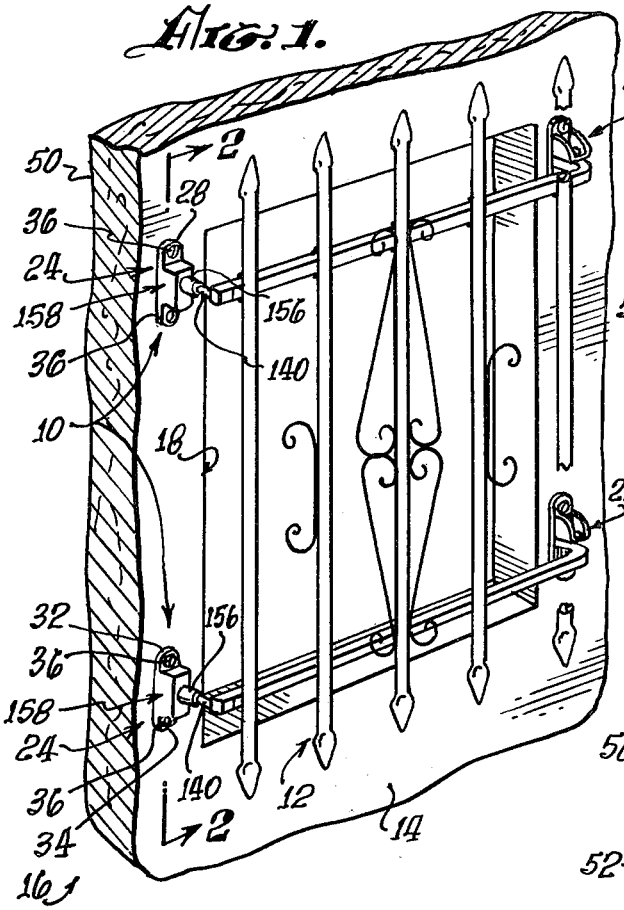
FIG. 3.
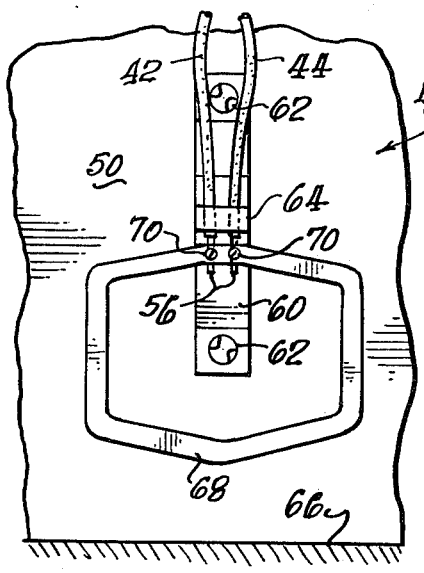
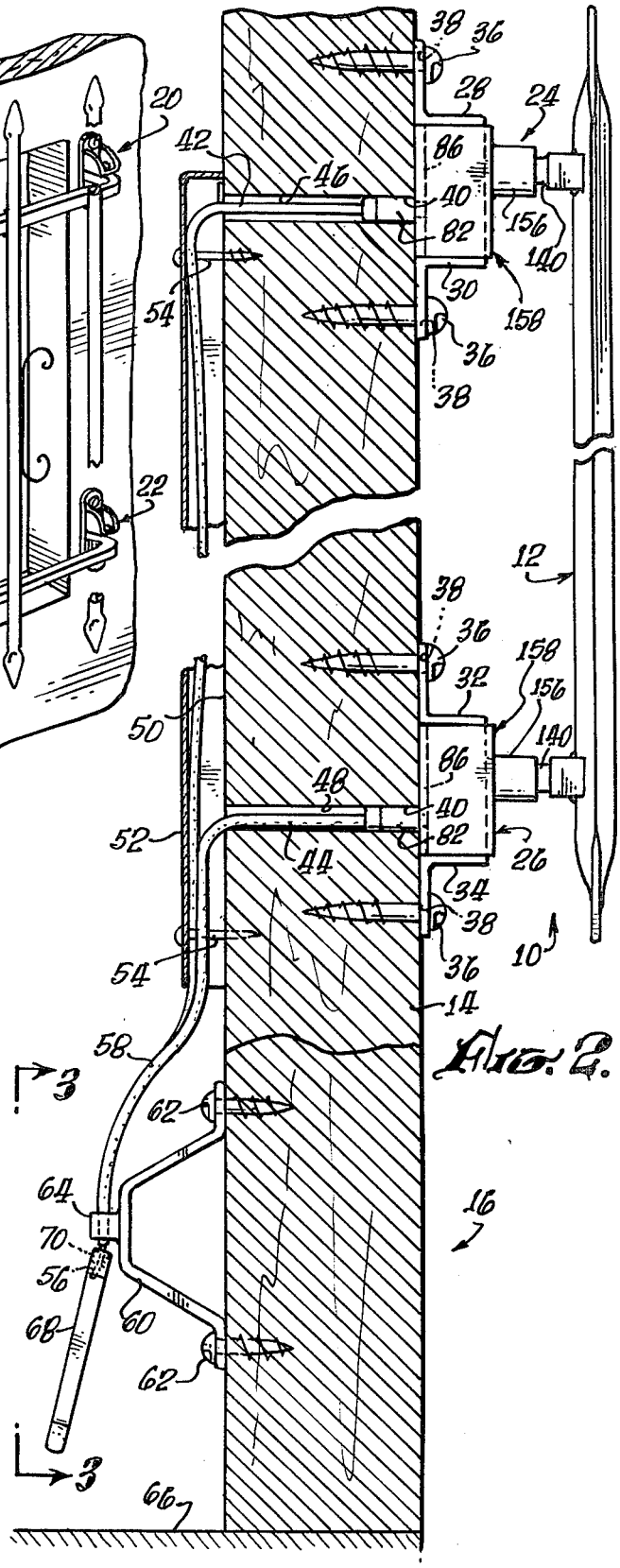
FIG. 2.

WINDOW GRILLE LATCH SYSTEM

BACKGROUND OF THE INVENTION

Decorative metal grilles and grates have been used for many years to enhance the beauty of houses and at the same time secure the windows and other openings to prevent unauthorized entry. In early times, these grates were permanently affixed to the structure about the window, however, it quickly became apparent that not only did such grilles prevent entry from the outside but they also prevented emergency exit from within the building, many times with tragic results. Thereafter grilles have been hinged and lock mechanisms are employed to retain the grille in position blocking the window except during times of emergency. If the key or other device required to open the lock mechanism is placed remotely from the mechanism, the grille becomes dangerous especially to strangers or children attempting to open the grille. When easily manipulated mechanisms are employed, a screen or mesh must be used in addition to the grille to prevent an intruder from reaching through the grille and unlocking the mechanism.

Some lock mechanisms have been operable through the adjacent wall utilizing chains or the like which are secured a sufficient distance away from the window that an intruder cannot reach them. Unfortunately to open such grilles requires that the chain be dragged out through the hole. On occasion the chain gets hung up and prevents the quick opening of the grille. A second type has been developed where nothing is dragged through the wall and what is in the wall stays in the wall. The latch stays outside the wall connected to some sort of lock mechanism on the interior wall so that the possibilities of hang up are substantially less. Such devices heretofore have required either the aforementioned screen or mesh to prevent entry or a grossly oversized grille so that the lock mechanism is a sufficient distance away from the window to prevent its manipulation from the exterior of the building. In this latter case there have been occasions when the lock mechanism was so remote from the window that the untrained occupant could not operate the latch release successfully to open the grille and escape in emergency situations.

BRIEF DESCRIPTION OF THE PRESENT INVENTION

The present invention involves a latch or a plurality of latches positioned on the exterior wall of a building adjacent the window or other opening which is to be protected by a grille. The grille usually is hinged on one side and the latch or latches are placed on the other. The latches are connected by means of flexible cables fed through the wall and down the inside surface. The cables are protected by suitable armor so that they cannot be reached from outside the wall. The flexible cable, or cables, are connected to a single stirrup adjacent the floor which one can operate by applying one's foot into the stirrup to open the latches. Since the flexible cables are connected to the same stirrup, in an emergency, such as when fire and smoke are present in the room, an individual can easily operate the stirrup to release both latches. This is becoming a requirement in locations with strict fire codes since fire departments in emergency conditions do not like the individual to have to undo more than one device in order to get the window open and escape.

The stirrup, because of its location is easily reached by a person lying or crawling on the floor in order to avoid the smoke in a smoke filled room, or by a child. This is advantageous because a person is likely to be crawling on the floor in the smoke-filled room situation and by being operable at a child's level, eliminates the need for a child to climb up a ladder or other device to open the latches as is required in prior art devices.

The latch itself includes a cylindrical member having a penetrator head with a radial slot formed therebehind. The cylinder is firmly attached to the grille such as by welding. When the grille is closed, the penetrator head splits a two piece orifice which initially is oval in shape and biased to that shape. When split along the line of the major axis of the oval by the penetrator head, the members expand to a circular configuration and drop into the slot which is sized to mate therewith.

When it is desired to open the grille by pulling on the flexible cable, force on the cable forces a conically shaped member between two rollers, or roll pins, each attached to one of the members forming the aforementioned oval orifice so that the conical member spreads the rollers or roll pins and the oval unit the penetrator member is released. It is preferable that the penetrator member be spring loaded away from the latch when latched so that the opening of the orifice causes the penetrator member and the connected grille to spring backwardly and to open partially thereby assuring the latch does not relatch upon release of the stirrup.

It is therefore an object on the present invention to provide improved means for securing a grille in position protecting an opening in a dwelling or other structure.

An object is to increase the safety of homes equipped with grille-type window guards.

An object of the invention is the provision of an improved grille locking and release system which prevents operation and release by unauthorized persons and intruders from outside the building wall with the opening in which the grille is mounted.

An object is to provide a latch system for window grilles which is adaptable to many sizes of windows and which has a single point of release.

Another object is to provide a grille locking and release system which is relatively economical to manufacture, simple, trouble-free and secure.

Another object is to provide a grille release system whose operation is evident upon inspection and which, when operated, obviously releases the grille.

Other objects and advantages of the present invention will become apparent to those skilled in the art after considering the following detailed specification which covers a preferred embodiment thereof in conjunction with the accompanying drawings wherein:

BRIEF DESCRIPTION OF THE DRAWINGS

FIG. 1 is a perspective view of a window grille in position adjacent a window retained by a latch system constructed according to the present invention;

FIG. 2 is a broken cross-sectional view taken at line 2—2 on FIG. 1;

FIG. 3 is a view of the stirrup employed with the present invention taken on line 3—3 in FIG. 2;

DETAILED DESCRIPTION OF THE PREFERRED EMBODIMENT

Figure 4:
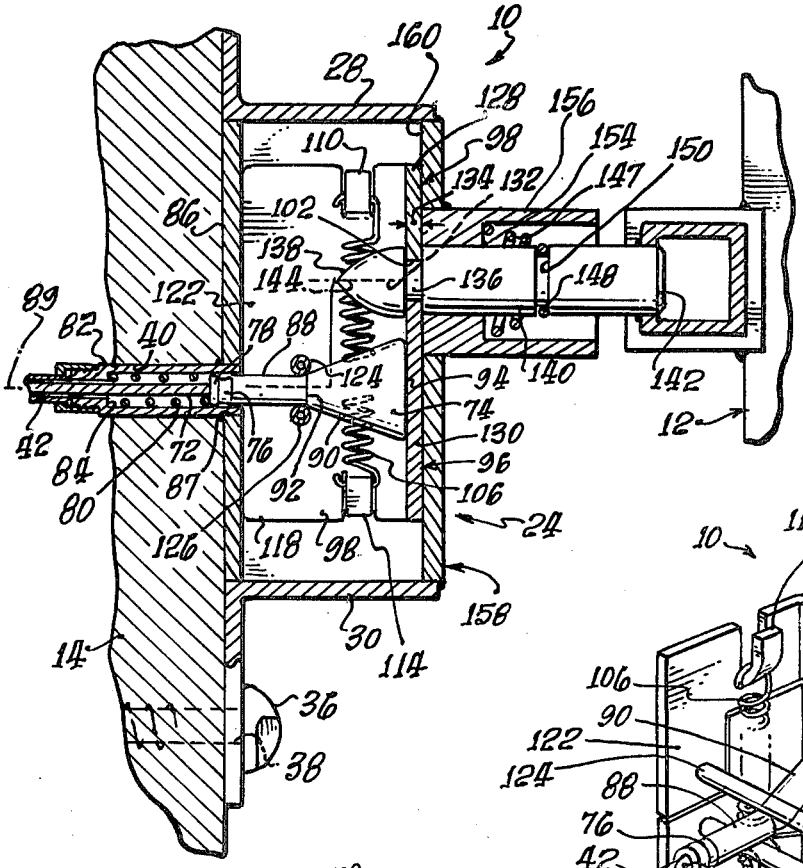
FIG. 4 is an enlarged cross-sectional side view taken through a latch of the system of FIG. 1 through 3 with the grille in a closed position.

Referring to the drawings more particularly by reference numbers, number 10 in FIG. 1 refers to a latch system constructed according to the present invention. The system 10 is shown retaining a grille 12 connected to the exterior wall 14 of a structure 16 in front of a window opening 18 which is representative of the various openings present in habital structures. The grille 12 is connected to the structure 16 by means of hinges 20 and 22 of suitable conventional type. Without the latch system 10, the grille 12 would be free to swing away from the window opening 18 so that unrestricted passage could be accomplished therethrough.

The grille 12 can be retained in a closed position by means of essentially identical latch assemblies 24 and 26 shown. It sould be realized that in some applications one or many more than two latch assemblies 24 and 26 shown may be provided to secure the grille 12. As shown in FIG. 2, the latch assemblies 24 and 26 include sidewardly extending tabs 28, 30, 32 and 34 respectively, which are secured to the structure 16 by suitable means such as one way screws 36 which pass through suitable holes 38 in the L-shaped tabs. It is preferable that the tabs 28 and 30 or 32 and 34 are firmly and fixedly attached to the remainder of the latch assembly 24 or 26 such as by welding.

Within the exterior wall 14 and shielded by the assembly 24 and 26, each assembly includes an inlet opening 40 out from which extends a flexible cable 42 or 44 which passes through the structure 16 and a hole 46 or 48 aligned with the opening 40 and provided for that purpose. The cables 42 and 44 extend down the interior wall 50 inside armor means which is shown as multiple sections of channel-shaped housing 52, firmly connected to the interior wall 50 by suitable means such as the screws 54 shown. The channel housing 52 prevents an intruder from breaking the window and operating the cables 42 and 44 from outside the window. For this reason the channel housing 52 extends down the interior wall 50 a distance suitable to prevent free access to the cables 42 and 44.

The cables 42 and 44 which are usually constructed of flexible metal cable strands 56 inside a sheath 58, extend down to a sheath supporting bracket 60 which is secured to the interior wall 50 by suitable means such as the one-way screws 62 shown. The bracket 60 retains the sheaths in a clamp 64 a suitable distance above the floor 66. A stirrup 68, having means such as the screw clamps 70 shown engages the cable strands 56 so that a downward pull thereon causes the cable strands 56 to move downwardly with respect to the sheaths 58. As will be described hereinafter this causes the latch assemblies 24 and 26 to release the grille 12 to allow free exit through the window opening 18. Although many suitable means are available to connect the cable strands 56 to the stirrup 68, it is preferable that such means be separate for each cable strand 56 so that they can be adjusted individually to assure that both latch assemblies 24 and 26 operate when the stirrup 68 has been pulled downwardly a predetermined amount.

Figure 6:
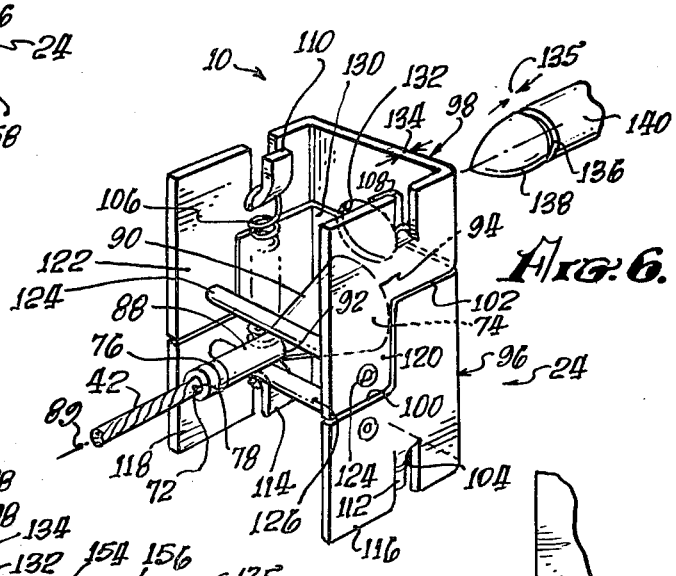
FIG. 6 is a perspective detail view of the latch of FIGS. 4 and 5.
Figure 5:
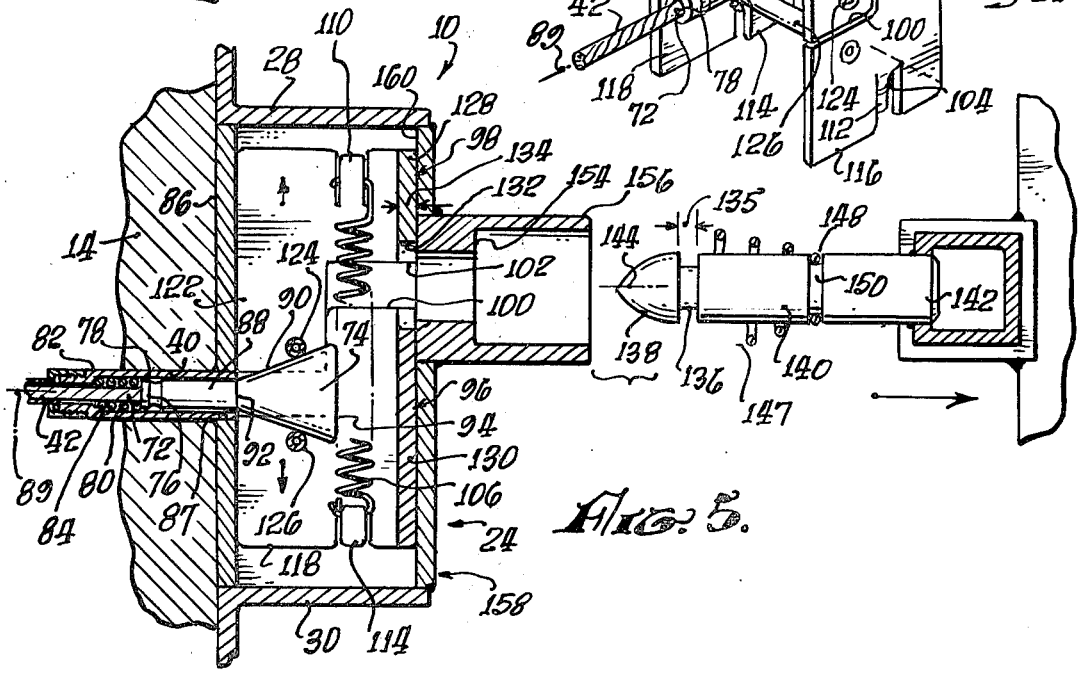
FIG. 5 is a cross-sectional side view similar to FIG. 4 with the latch in a released position.

The latch assemblies 24 and 26 are identical as aforesaid and latch assembly 24 is shown in detail in FIGS. 4, 5 and 6. When it is desired to release the grille 12, the cable strand 56 is pulled downwardly as aforesaid. The end 72 of the cable strand 46 opposite from the stirrup 68 is connected to a conical spreader member 74 usually by means of a swaged portion 76. The end 78 of the conical spreader member 74 adjacent the swage 76 is abutted by a compression spring 80 retained about the cable strand 56 by a housing 82 having an abutment surface 84 at its extremity. The housing 82 which usually is tubular in shape is firmly attached to the backplate 86 of the latch assembly 24 by suitable means such as by welding. The housing 82 extends through a hole 87 in the backplate 86 as does the member 74.

The conical speader member 74 includes a cylindrical portion 88 which is sized to slide within the tubular housing 82 so that the motion of member 74 is restricted to movement along the axis 89 thereof. The member 74 also includes a frustroconical portion 90, the smaller end 92 of which being connected to the cylindrical portion 88 while the opposite end 94 forms an abutment surface which engages the lower member 96 of the upper and lower latch members 98 and 96.

The latch member 96 and 98 are generally channel shaped and have stepped mating abutment surfaces 100 and 102 therebetween (FIG. 6) which surfaces are forced together by means of tension springs 104 and 106 connected to act across the surfaces 100 and 102 by means of inwardly extending tabs 108 and 110 which are portions of member 98 and tabs 112 and 114 which are portions of the member 96. The latch member 96 and 98 being channel shaped each have opposite side portions 116 and 118 and 120 and 122. A roll pin or spreader bar 124 extends from side 120 to 122 on the upper latch member 98 and a similar roll pin or bar 126 extends from side 116 to 118. When the surfaces 100 and 102 are in contact, the distance between the roll pins 124 and 126 is chosen to provide clearance for the cylindrical portion 88 of the conical spreader member 74 which is positioned therebetween. When the cable strand 56 is pulled, the frustroconical portion 90 of the member 74 wedges between the two bars 124 and 126 spreading them against the force applied by the springs 104 and 106.

The central portions 128 and 130 of the latch members 96 and 98 include an oval cutout 132 whose major axis is in alignment with the surfaces 100 and 102 as they cross the central portions 128 and 130 of the members 96 and 98. The central portions 128 and 130 adjacent the oval cutout 132 are constructed from material having predetermined a width 134 which is just less than the width 135 of radial slot 136 formed adjacent the head 138 of a cylindrical penetrator member 140 whose opposite end 142 is suitably attached to the grille 12 by means such as welding. The minor axis 144 of the oval cutout 132 is just slightly larger than the diameter of the penetrator member 140 at the bottom of the slot 136 so that when the assembly 24 is in the closed and locked position shown in FIG. 4 the central portions 128 and 130 adjacent the cutout 132 retain the penetrator member 140 in the position shown. When the cable strand 56 is pulled to thereby spread apart the two latch members 96 and 98, the cutout 132 is made more nearly circular so that the head 138 is free to withdraw therefrom. Withdrawal of the head 138 and thereby release of the grille 12 from the latch assembly 24 is assured by a compression spring 147 centrally about the member 140. A reduced end portion 148 of spring 147 which is positioned in an annular groove or slot 150 in the member 140 to retain the spring 147 between the groove and an abutment surface 154 in a cylindrical housing 156 which extends outwardly from the main housing 158 of the assembly 24. When the head 138 is released, the compression spring 147 pushes the member 140 out of the cutout 132 so that there is no chance that it will relatch prior to opening of the grille 12. Such would be undesirable as it would require two coordinated actions, that is, pulling the stirrup 68 and pushing on the grille 12 at the same time.

The main housing 158 is preferably channel shaped having an inner surface 160 which matches the outer surfaces of the latch members 96 and 98 which slide vertically thereon and are otherwise retained.

Once the grille has opened as shown in FIG. 5 and it is desired to close the grille, a simple pulling on the grille 12 causes the bullet shaped head 138 to strike and wedge open the cutout 132 at its minor axis 144. The cutout 132 is held and maintained in proper position for engagement and spreading by the head 138 by the bars 124 and 126 whose vertical position is maintained by the cylindrical portion 88 of the conical spreader member 74. Once the head 138 has been inserted in the cutout 132, a sufficient distance, the springs 104 and 106 cause the cutout to snap into the slot 136 to thereagain lock the grille 12 in place and secure the dwelling against intruders while remaining ready to be operated quickly in an emergency.

Thus there has been shown and described a novel grille latch system which fulfills all the objects and advantages sought therefor. Many changes, modifications, variations, other uses and applications of the subject invention will, however, become apparent to those skilled in the art after considering this specification. All such changes, modifications, variations, and other uses and applications which do not depart from the spirit and scope of the invention are deemed to be covered by the invention which is limited only by the claims which follow.

The inventor claims:

1. A system for retaining a hinged protective cover over an opening in a structure having an interior wall surface and a floor, the structure commonly being occupied by human beings, said system including:

a penetrator member connected to the protective cover; and a latching assembly connected to the structure adjacent the opening for releasably retaining said penetrator member thereto, said latching assembly including a pair of opposed latching members adapted to engage said penetrator member, bias means connected between said opposed latching members tending to retain said opposed latching members in penetrator member retaining positions, means to forcefully operate said opposed latching members including a cable connection which extends within the structure so that force manually applied thereto operates said opposed latching members, armor means covering said cable, said armor being located within the structure in position to protect the cable where it could be reached from outside the structure, an operating handle connected to said cable on the end thereof opposite said latching members which extends beyond said armor means, a cover in which said opposed latching members are retained, said cover including a protected opening for receiving said penetrator member, means for securing said cover to the structure and an opening facing the structure through which said cable extends, and second bias means connected between said latching assembly and said cable to bias said cable to its penetrator member retaining position, said cable extending down the interior wall protected by said armor means and said handle being adjacent the floor, whereby said penetrator member is retained in said latching members until they are operated by a cable movement caused by movement of said handle and released thereafter, said opposed latching members further include spaced facing abutment surfaces, said latching assembly including a frustro-conical spreader member positioned between said spaced facing abutment surfaces, said frustro-conical spreader member having a smaller portion and a larger portion, said smaller portion of which is connected to said cable on the end thereof opposite said handle, whereby handle movement causes said frustro-conical spreader member to spread said abutment surfaces of said latching members and release said penetrator member, and said penetrator member including a spring retaining abutment surface, and a spring retained thereby facing said cover so that when said penetrator member is retained by said latching assembly, said spring is stressed and tends to push said penetrator member and said assembly apart, thus assuring separation thereof when said handle is operated.

2. The system defined in claim 1, wherein:

said penetrator member has a cylindrical head backed by a slot which is shaped and sized to be engaged by said latching members, said latching members defining an oval cutout therebetween whose major axis is larger than the diameter of said head and whose minor axis is smaller than the diameter of said head.

3. The system defined in claim 2, wherein:

said penetrator head is bullet shaped for easy insertion in said cutout.

4. The system defined in claim 2, wherein:

said latching members have a predetermined thickness adjacent said cutout, said slot having a width which is just wider than said predetermined thickness.

5. The system defined in claim 4, wherein:

said slot is a radial slot.

6. The system defined in claim 1, wherein:

said armor means include sections of channel shaped members which are secured to the interior wall of the structure and with the interior wall surround said cable.

7. The system defined in claim 1 wherein:

said cover includes a hollow cylindrical housing which extends within the interior wall, said frustro-conical member including a cylindrical extension at its smaller end which attaches to said cable and is restrained to axial sliding movement in said hollow cylindrical housing.

* * * * *